US008186198B2

(12) United States Patent
Hanke

(10) Patent No.: US 8,186,198 B2
(45) Date of Patent: May 29, 2012

(54) ROLLING INSTALLATION

(75) Inventor: Hans-Jürgen Hanke, Hilchenbach (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 944 days.

(21) Appl. No.: 11/921,193

(22) PCT Filed: Jul. 24, 2006

(86) PCT No.: PCT/EP2006/007251

§ 371 (c)(1),
(2), (4) Date: Nov. 28, 2007

(87) PCT Pub. No.: WO2007/022842

PCT Pub. Date: Mar. 1, 2007

(65) Prior Publication Data

US 2009/0217727 A1 Sep. 3, 2009

(30) Foreign Application Priority Data

Aug. 20, 2005 (DE) ..... 10 2005 039 474

(51) Int. Cl.
*B21B 9/00* (2006.01)

(52) U.S. Cl. ..... 72/236; 72/38

(58) Field of Classification Search ..... 72/38, 39, 72/201, 236, 342.2; 15/300.1, 306.1, 309.1, 15/345; 137/15.04, 15.05; 55/419
See application file for complete search history.

(56) References Cited

U.S. PATENT DOCUMENTS

| | | | | |
|---|---|---|---|---|
| 3,204,393 | A | 9/1965 | Torsten | |
| 5,313,685 | A * | 5/1994 | Kramer et al. | 15/309.1 |
| 6,928,753 | B2 * | 8/2005 | Richter et al. | 34/620 |

FOREIGN PATENT DOCUMENTS

| | | |
|---|---|---|
| EP | 0 114 535 | 8/1984 |
| EP | 0 765 696 | 4/1997 |
| JP | 62-146502 | 9/1987 |
| JP | 63-189403 | 12/1988 |
| WO | 03/068426 | 8/2003 |

* cited by examiner

*Primary Examiner* — Debra Sullivan

(74) *Attorney, Agent, or Firm* — Lucas & Mercanti, LLP; Klaus P. Stoffel

(57) ABSTRACT

The invention relates to a rolling installation comprising a roll stand (110) for rolling a metal strip and a suction device (120) for sucking polluted air from the immediate environment of the metal strip to be rolled. The aim of the invention is to structurally simplify the suction device. To this end, the inlet guiding region (112) is defined on one side by an inlet guiding plate (113) and the inlet suction channel (120) is connected to the inlet guiding region (112) via an opening (113-O) in the inlet guiding plate (113). The same arrangement can be applied to the discharge suction channel (124) and the discharge guiding region (114).

4 Claims, 2 Drawing Sheets

ROLLING INSTALLATION

BACKGROUND OF THE INVENTION

The invention concerns a rolling mill with at least one rolling stand for rolling a metal strip and with at least one exhaust system for carrying away fumes and dust from the surface of the metal strip before and/or after a rolling operation.

European Patent Application EP 0 765 696 A1 discloses a device for keeping cold rolled strip dry in the runout of cold rolling mills and strip mills. This device comprises a rigidly mounted partition and a movable partition articulated on the stationary partition in the runout of the mill for diverting liquid rolling medium in the vicinity of the strip runout. A roll body blower and a strip edge blower are integrated in the partition. Independently of the partition, the mill disclosed in D2 has a fume exhaust system in the vicinity of the metal strip A rolling mill of this type is basically already known from the prior art, for example, from U.S. Pat. No. 3,204,393. The development of the rolling mill disclosed in that patent arose from the problem that, in the exhaust systems that were known up until then, fume exhaust hoods with very large dimensions were used in the vicinity of rolling stands to exhaust dust, fumes, or gases, and the size and placement of these large exhaust hoods made it much more difficult to monitor the rolling mills during their operation. To solve this problem, the cited US patent proposes that so-called suction boxes, each with a suction slot, be assigned to the suction ducts on the run-in side and the runout side of the rolling mill. In this regard, each of the suction slots is arranged in the immediate vicinity of the roll gap, i.e., in the immediate vicinity of the site of formation of the dust and fumes. Due to the favorable placement or location of the suction slot, the amount of air necessary for effective exhausting of the dust and fumes and thus the dimensions of the suction boxes or suction hoods can be greatly reduced. Lifting devices, which are preferably pneumatically operated, are present on the run-in side and/or on the runout side of the rolling mill or rolling stand for optimum positioning of the height level of the suction boxes and of the associated roll strippers relative to the metal strip

SUMMARY OF THE INVENTION

With this prior art as a point of departure, the objective of the invention is to modify a previously known rolling mill with an exhaust system in such a way that the design of the exhaust system is simplified and thus less expensive.

In accordance with the invention, the rolling mill of the invention is characterized by the fact that the inlet suction duct and/or the outlet suction duct is integrated in the rolling stand and supported therein with a vertically straight orientation in proximity to the rolls in such a way that it extends into the inlet guide region and/or the outlet guide region.

In the context of the present invention, the term "contaminated air" is understood to be a comprehensive term for fumes, dust, smoke, and/or noxious gases, especially flue gases. The term "rolling stand" is applied to four-high roughing stands, two-high roughing stands and plate rolling stands in "rolling mills", which are generally designed as hot and cold sheet rolling mills.

The claimed design of the rolling mill or the exhaust system has the advantage that, compared to the prior-art exhaust system described above, it is designed without complicated and thus expensive suction boxes. Therefore, it has a simpler design and can be produced with less expense. Nevertheless, it guarantees effective exhausting of contaminated air from the vicinity of the rolled strip, because the suction is applied near the roll gap, without the need for oversized suction hoods and without the need for drawing in unnecessarily large amounts of outside air from the building that houses the rolling mill. Due to the claimed integration of the inlet suction duct and/or the outlet suction duct in the rolling stand, the rolling stand and the entire rolling mill can be constructed in a way that is very compact, i.e., space-saving.

In accordance with a first embodiment of the invention, it is advantageous if the openings in the inlet guide plates and/or the openings in the outlet guide plates are designed as slots. The slots guarantee that only the relatively small particles which pass through the slots are carried away from the vicinity of the metal strip by the exhaust system; at the same time, relatively large particles or foreign bodies that do not pass through the slots are retained by the slots. The latter feature has the advantage that the retained foreign bodies cannot damage the exhaust system, especially a ventilator that is part of the exhaust system.

In accordance with another embodiment of the invention, the inlet suction duct and the outlet suction duct each have a stationary main section and a section on the inlet side and the outlet side, respectively, that can be moved. The movable section on the inlet side and/or the outlet side, respectively, can then be telescopically displaced relative to the stationary main section with which it is associated. In this way, the inlet suction duct and/or the outlet suction duct can be adjusted in height relative to the surface of the metal strip, always depending on the particular metal strip thickness that is desired or has been set, so that optimum exhausting of the contaminated air is always guaranteed.

It is advantageous if the sections on the inlet side and outlet side, together with the guide plates and the roll strippers that are present, are moved by a drive system, which is preferably designed in the form of hydraulic cylinders.

The specification is accompanied by three schematic drawings.

DETAILED DESCRIPTION OF THE INVENTION

Figure 1:
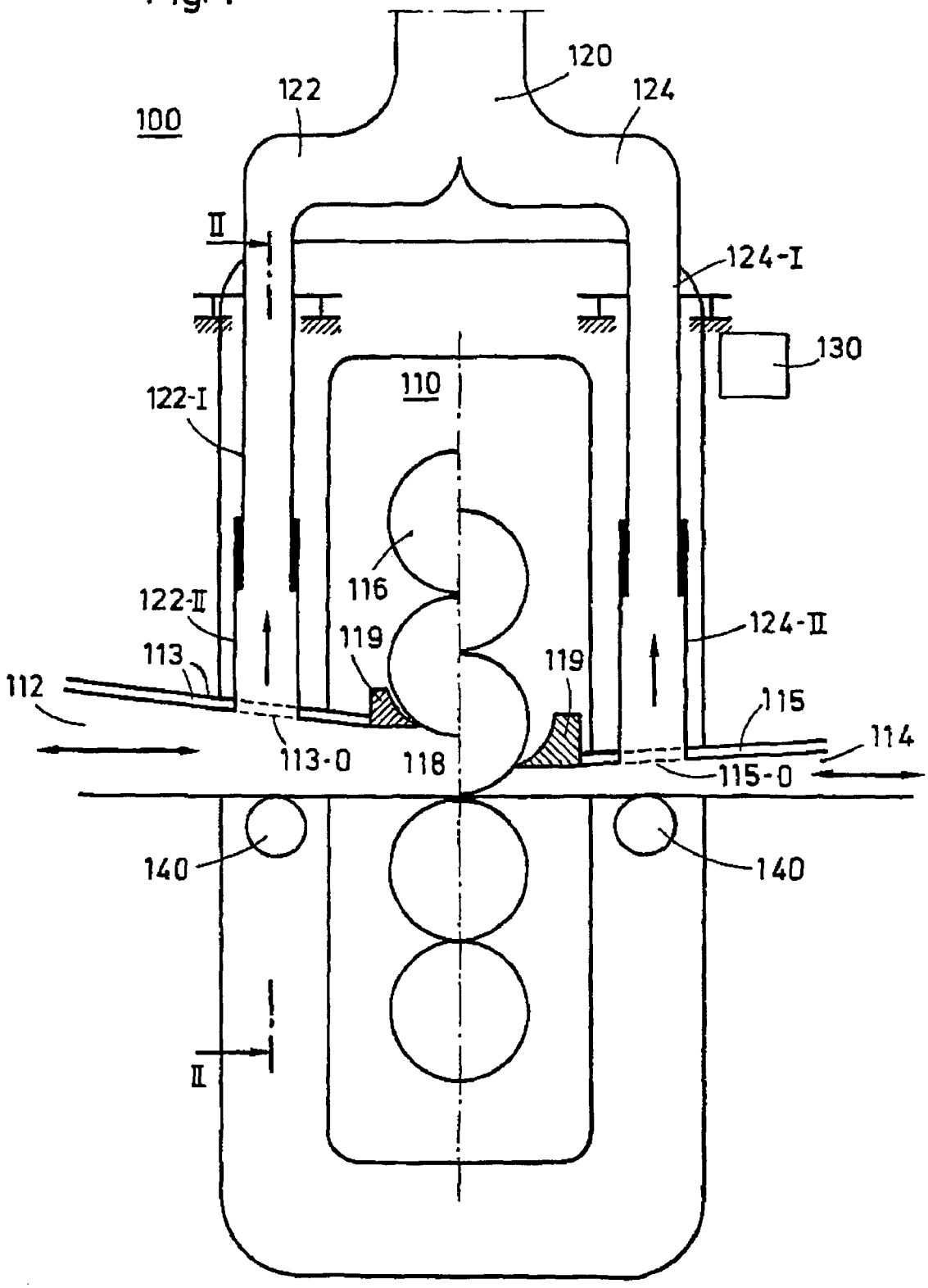
FIG. 1 shows a rolling stand of a rolling mill in accordance with the invention.

FIG. 1 shows a rolling mill 100. The rolling mill 100 comprises a rolling stand 110 with rolls 116 for rolling a metal strip. The rolling stand 110 also comprises an inlet guide region 112 for feeding the metal strip into a roll gap 118 and an outlet guide region 114 for guiding the metal strip out of the rolling stand 110 after a rolling operation. In addition, the rolling stand 110 has an exhaust system 120 for carrying contaminated air away from the immediate vicinity of the metal strip and especially from the surface of the metal strip. The exhaust system 120 comprises an inlet suction duct 122 that leads into the inlet guide region 112 and/or an outlet suction duct 124 that leads into the outlet guide region 114. The inlet suction duct 122 is connected with the inlet guide region 112 by an opening 113-O in an inlet guide plate 113, which bounds the inlet guide region 112. Similarly, the outlet suction duct 124 is connected with the outlet guide region 114 by an opening 115-O in an outlet guide plate 115, which bounds the inlet guide region 114. In order to be able to suction off the contaminated air, i.e., fumes, dust, smoke, or gases, as efficiently as possible, both the inlet suction duct 122 and the outlet suction duct 124 are positioned as close as possible to the roll gap 118, i.e., as close as possible to the immediate vicinity of the site of formation of the contaminated air.

As FIG. 1 shows, preferably both the inlet suction duct 122 and the outlet suction duct 124 are designed to telescope. Both ducts have a stationary main section 122-I, 124-I, and a section 122-II, 124-II that can be moved relative to the stationary main section. The movement is effected with a drive system 130, which is preferably designed in the form of hydraulic cylinders 131 (not shown in FIG. 1). The inlet-side section 122-II of the inlet suction duct 122 opens into the opening 113-O in the inlet guide plate 113. At its end on the inlet side, the section 122-II is preferably mounted on the inlet guide plate 113 and is then moved together with the inlet guide plate 113 relative to the main section 122-I. The movement is made according to a given, currently desired size of the roll gap 118. Similarly, the outlet-side section 124-II of the outlet suction duct 124 is connected with the outlet guide plate 115 and can be moved together with the latter according to the given, currently desired size of the roll gap 118. The inlet guide plate 113 and the outlet guide plate 115 are always in contact with the roll strippers 119; the guide plates 113, 115 are each moved together with the roll strippers 119 according to the current desired size of the roll gap 118.

FIG. 1 also shows conveyor rollers 140, by which the metal rolling stock is conveyed into or out of the rolling stand. The arrows directed vertically upward in the inlet suction duct 122 and the outlet suction duct 124 indicate the direction in which the contaminated air is exhausted. The horizontally oriented double arrows, on the other hand, indicate the rolling direction W in which the metal strip passes through the rolling stand.

In accordance with the invention, both the inlet suction duct 122 and the outlet suction duct 124 are integrated in the rolling stand, so that the rolling stand and thus the entire rolling mill can be constructed in a way that is compact, i.e., space-saving. The integration of the aforesaid ducts in the rolling stand is possible especially due to the arrangement of the ducts in a straight vertical direction and close to the roll gap.

Figure 2:
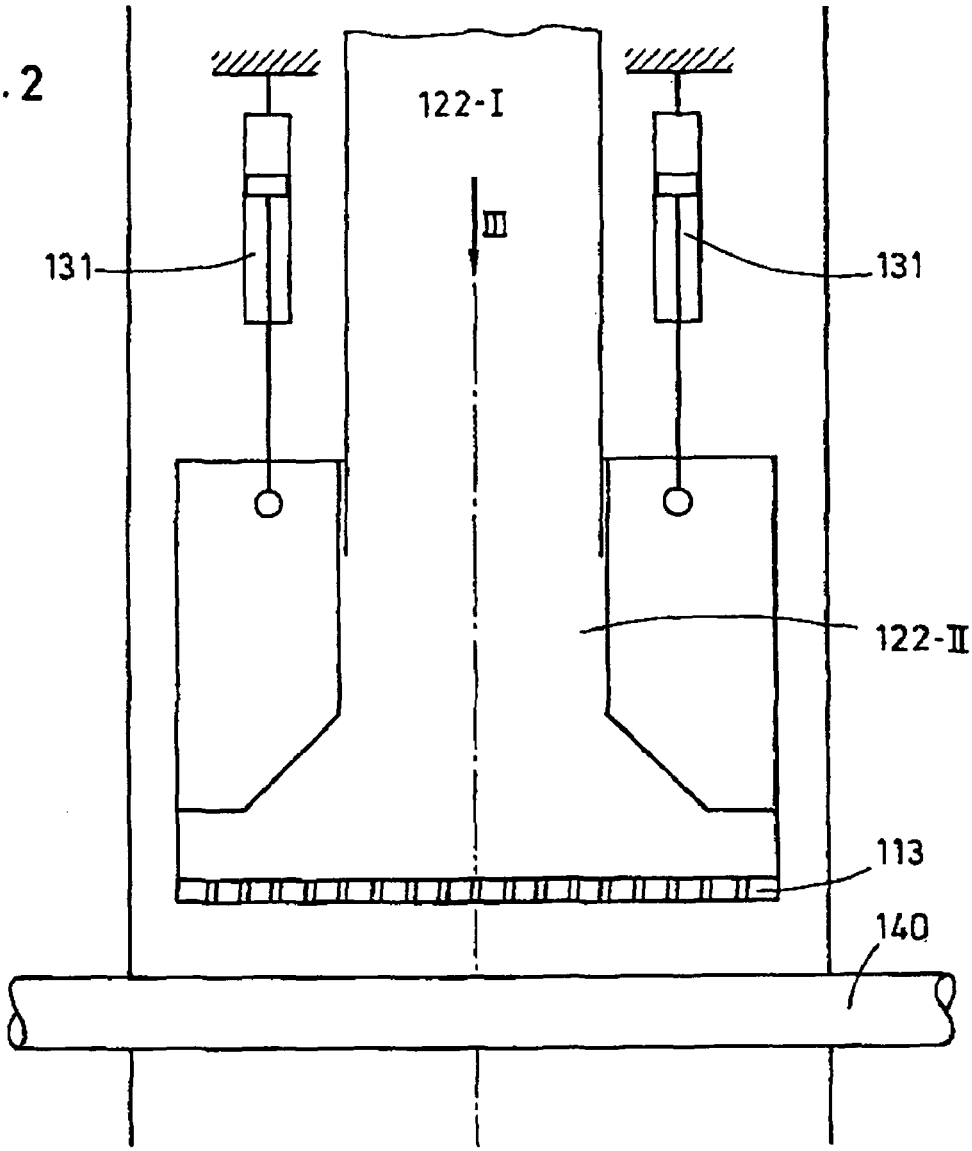
FIG. 2 shows a longitudinal section through an inlet suction duct.

FIG. 2 shows a side view of the inlet-side section 122-II of the inlet suction duct 122. It is apparent that this inlet-side section 122-II, at its end that extends into the opening 113-O, extends, if possible, over the entire width of the metal strip to be rolled. To save material and expense, but also for reasons related to exhaust engineering, the inlet-side section 122-II can taper more and more with increasing distance from the inlet guide region 112. The section 122-II is shown in both FIG. 1 and FIG. 2 arranged opposite the conveyor roller 140. These drawings are to be understood to be merely examples; the conveyor roller 140 could also be positioned in a different place.

Figure 3:
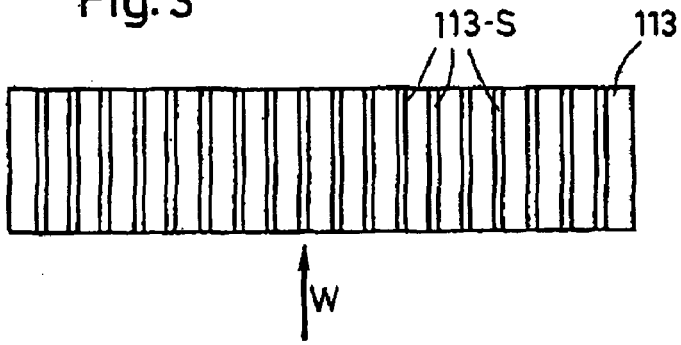
FIG. 3 shows a top view from the inside of the inlet suction duct towards the inlet guide plate in the direction opposite the direction of suction.

FIG. 3 shows a top view of the inlet end of the inlet-side section 122-II. As is already schematically illustrated in FIG. 2, FIG. 3 shows that the opening 113-O is divided into a plurality of small openings in the form of slots 113-S. The slots 113-S prevent relatively large pieces from being carried along by the exhaust system 120, which could otherwise become clogged or even destroyed by these large pieces of material. The drawings in FIGS. 2 and 3 of the inlet suction duct 122 apply equally to the analogous outlet suction duct 124.

The invention claimed is:

1. A rolling mill (100), which comprises at least one rolling stand (110) for rolling a metal strip, with an inlet guide region (112) for guiding the metal strip into a roll gap (118) of the rolling stand (110) and an outlet guide region (114) for guiding the metal strip out of the rolling stand; and which comprises an exhaust system (120) for exhausting contaminated air from the immediate vicinity of the metal strip with an inlet suction duct (122), which is connected with the inlet guide region (112) close to the roll gap by an opening (113-O) in an inlet guide plate (113) that bounds the inlet guide region (112) and with an outlet suction duct (124), which is connected with the outlet guide region (114) close to the roll gap by an opening (115-O) in an outlet guide plate (115) that bounds the outlet guide region (114), wherein the inlet suction duct (122) and the outlet suction duct (124) are integrated in the rolling stand (110) and supported therein with a vertically straight upward orientation in proximity to the rolls (116) in such a way that they extend vertically directly into the inlet guide region (112) and the outlet guide region (114).

2. A rolling mill (100) in accordance with claim 1, wherein the opening (113-O) in the inlet guide plate (113) and/or the opening (115-O) in the outlet guide plate (115) is designed in the form of slots (113-S), which are distributed over the width of the given guide plate (113, 115), preferably parallel to the rolling direction (W).

3. A rolling mill (100) in accordance with claim 1, wherein the rolling mill also has a drive system (130), preferably in the form of hydraulic cylinders (131), for moving the inlet suction duct (122) and/or the outlet suction duct (124) together with the respective guide plate (113, 115), and that the inlet guide plate (113) and/or the outlet guide plate (115) are in contact with roll strippers (119) and are each moved together with the roll strippers (119) according to the current desired size of the roll gap (118).

4. A rolling mill (100), which comprises at least one rolling stand (110) for rolling a metal strip, with an inlet guide region (112) for guiding the metal strip into a roll gap (118) of the rolling stand (110) and an outlet guide region (114) for guiding the metal strip out of the rolling stand; and which comprises an exhaust system (120) for exhausting contaminated air from the immediate vicinity of the metal strip with an inlet suction duct (122), which is connected with the inlet guide region (112) close to the roll gap by an opening (113-O) in an inlet guide plate (113) that bounds the inlet guide region (112) and/or with an outlet suction duct (124), which is connected with the outlet guide region (114) close to the roll gap by an opening (115-O) in an outlet guide plate (115) that bounds the outlet guide region (114), wherein the inlet suction duct (122) and/or the outlet suction duct (124) is integrated in the rolling stand (110) and supported therein with a vertically straight orientation in proximity to the rolls (116) in such a way that it extends into the inlet guide region (112) and/or the outlet guide region (114), wherein the inlet suction duct (122) has a stationary main section (122-I) and a movable section (122-II) on the inlet side, where the movable section (122-II) on the inlet side is preferably joined with the inlet guide plate (113) and can be telescopically moved together with the inlet guide plate (113) relative to the stationary main section (122-I) of the inlet suction duct (122) according to a currently desired size of the roll gap (118), and/or the outlet suction duct (124) has a stationary main section (124-I) and a movable section (124-II) on the outlet side, where the movable section (124-II) on the outlet side is preferably joined with the outlet guide plate (115) and can be telescopically moved together with the outlet guide plate (115) relative to the stationary main section (124-I) of the outlet suction duct (124) according to the currently desired size of the roll gap (118).

* * * * *